United States Patent [19]

Tajima et al.

[11] 4,142,948

[45] Mar. 6, 1979

[54] CHROMIUM DEPOSITION SOLUTION

[75] Inventors: Sakae Tajima, Tokyo; Takashi Mouri, Kanagawa; Shigeyoshi Morisaki, Yokohama, all of Japan

[73] Assignee: Toyo Soda Manufacturing Co., Ltd., Japan

[21] Appl. No.: 881,845

[22] Filed: Feb. 27, 1978

[30] Foreign Application Priority Data

Feb. 28, 1977 [JP] Japan ..... 52-20252

[51] Int. Cl.[2] ..... C25D 3/06; C25D 3/56

[52] U.S. Cl. ..... 204/43 R; 204/51

[58] Field of Search ..... 204/51, 43 R, 43 T

[56] References Cited

U.S. PATENT DOCUMENTS 3,706,636 12/1972 Bride ..... 204/51

3,954,574 5/1976 Gyllenspetz et al. ..... 204/43 T 4,062,740 12/1977 Bauer et al. ..... 204/51

FOREIGN PATENT DOCUMENTS 480945 3/1938 United Kingdom ..... 204/51

*Primary Examiner*—G. L. Kaplan

*Attorney, Agent, or Firm*—Cushman, Darby & Cushman

[57] ABSTRACT

Disclosed is an aqueous chromium deposition solution containing chromium in the trivalent state, from which a bright decorative chromium plate can be advantageously formed. The chromium deposition solution contains (a) a water-soluble trivalent chromium salt; (b) at least one compound selected from unsubstituted and amino- or hydroxy-substituted carboxylic acids and salts thereof; (c) a water-soluble aluminum salt, and; (d) ammonium ion.

5 Claims, 4 Drawing Figures

CHROMIUM DEPOSITION SOLUTION

Figure 1A:
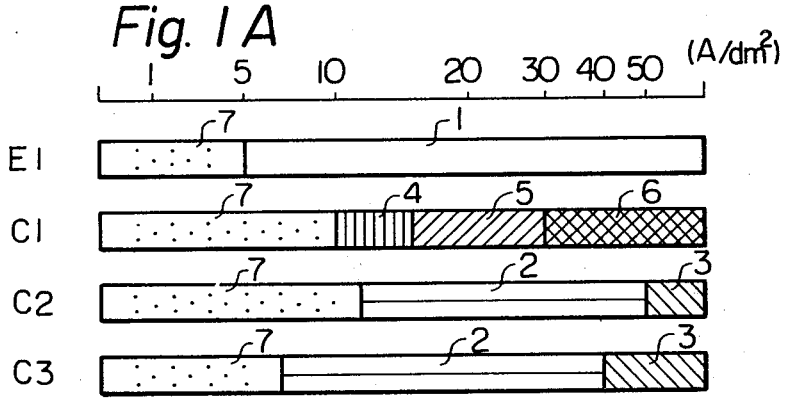

This invention relates to an aqueous chromium deposition solution containing chromium in the trivalent state, which solution is useful particularly for decorative chromium plating.

Decorative chromium plating is popularly employed in plating industries to provide a decorative plate with a desirable bright finish and corrosion resistance. Hitherto, a chromium plating bath containing chromium in the hexavalent state, for example, prepared from chromic anhydride and a minor amount of sulfuric acid, has been broadly used. However, the hexavalent chromium-containing bath has the defects that it is poor in covering power and throwing power of the chromium deposit, and the current efficiency for the deposition is at most ten-odd percent as calculated based on hexavalent chromium. Furthermore, the use of hexavalent chromium has recently caused public discussion because its disposal gives rise to serious environmental pollution due to its toxicity.

Many proposals have been made to use plating baths containing chromium in the trivalent state. For example, U.S. Pat. No. 3,706,636 discloses a plating bath having preformed or formed in situ a complex, water-soluble chromic compound containing carboxylic acid constituents and halogen constituents. This patent states that such plating bath is of good plating speed in the low current density region. However, the current density region providing a surface of the desired bright range is relatively narrow.

Further, U.S. Pat. No. 3,954,574 discloses an aqueous plating solution containing a trivalent chromium salt, formic and/or acetic acid salt, a bromide, borate and ammonium. Precipitates tend to be produced in this plating bath and when the plating operation is carried out at a temperature exceeding approximately 30° C., "burning" is liable to be formed on the chromium plate.

A main object of the present invention is to provide an aqueous chromium deposition solution, from which a decorative chromium deposit with a desirable bright finish is obtained easily and over a broad current density range.

Other objects and advantages of the present invention will be apparent from the following description.

In accordance with the present invention, there is provided an aqueous chromium deposition solution which contains, in dissolved form:

a. a trivalent chromium salt in a molar concentration of from 0.1 to saturation expressed in terms of the molar concentration of trivalent chromium;

b. at least one compound selected from unsubstituted aliphatic carboxylic acids, amino-substituted aliphatic carboxylic acids, hydroxy-substituted aliphatic carboxylic acids and salts thereof, said compound having 1 to 5 carbon atoms in the molecule, in a concentration such that the molar ratio of the total carboxyl or carboxylate groups to the total trivalent chromium atoms in the salt (a) is within the range of from 0.5 to 5.0;

c. an aluminum salt in a molar concentration of from 0.1 to 2.0 expressed in terms of the molar concentration of aluminum, and;

d. ammonium ion in a molar concentration of at least 0.2.

The trivalent chromium salt used is not particulary restricted, and may be selected from conventional water-soluble trivalent chromium salts. Halides, such as chromic chloride, chromic fluoride and chromic bromide, and sulfates, such as chromic sulfate, basic chromic sulfate and chromium alum, are conveniently used. These chromic salts may be used either alone or in combination. The concentration of such trivalent chromium salt in the deposition solution may be varied within the range of from 0.1 molar concentration to saturation, expressed in terms of the molar concentration of trivalent chromium. When the concentration of the trivalent chromium salt is outside this range, the covering power of the chromium deposit is poor and the current density region providing a deposited surface of the desired bright range is undesirably narrow.

The above-mentioned ingredient (b), i.e., a carboxyl or carboxylate group-containing compound, has 1 to 5 carbon atoms in the molecule, and includes amino-substituted aliphatic carboxylic acids, such as aminoacetic acid and glutamic acid; unsubstituted aliphatic carboxylic acids, such as oxalic acid, malonic acid, succinic acid, maleic acid, formic acid and acetic acid; hydroxy-substituted aliphatic carboxylic acids, such as malic acid, glycolic acid and lactic acid, and; alkali metal, alkali earth metal or ammonium salts thereof. These acids and salts may be used either alone or in combination. It is presumed that these acids and salts form a complex of trivalent chromium in the deposition solution, which complex advantageously acts for the formation of a decorative chromium or deposit plate with a highly desirable bright finish and for the prevention of formation of an undesirable black powdery electrodeposit.

The concentration of the carboxyl or carboxylate group-containing compound in the deposition solution should be such that the molar ratio of the total carboxyl and/or carboxylate groups to the total trivalent chromium atoms is within the range of from 0.5 to 5.0. When the molar ratio is smaller than 0.5, the resulting decorative chromium deposit is poor in the brightness of the finish. In contrast, when the molar ratio exceeds 5.0, the covering power of the chromium deposit is reduced.

The aluminum salt is crucial, and the chromium deposition solution of the invention is characterized particulary as containing a combination of the carboxyl or carboxylate group-containing compound and the aluminum salt. Even if an aluminum salt is incorporated in a chromium deposition solution not containing the carboxyl or carboxylate group-containing compound, the deposition performance is not satisfactory because a chromium deposit is obtainable only in a narrow current density region and the brightness of the finish is poor. In contrast, when an aluminum salt is incorporated in a chromium deposition solution together with the carboxyl or carboxylate group-containing compound, a decorative surface with a desirable bright finish is obtained over a broad current density range, and both the covering power of chromium deposit and the current efficiency are enhanced. Furthermore, the aluminum salt exhibits a buffering effect for the deposition solution during deposition operation. The aluminum salt is converted, at a pH of approximately 7, into aluminum hydroxide, which acts as a precipitant or coagulant and hence is advantageously used for the after-treatment of the deposition solution.

The aluminum salt used includes water-soluble salts such as aluminum sulfate, aluminum chloride and aluminum bromide. The concentration of the aluminum salt in the deposition solution may be varied within the range of from 0.1 to 2 molar concentration, expressed in terms of the molar concentration of aluminum.

The ammonium ion is formed in the deposition solution by incorporating thereinto an ammonium salt, such as ammonium sulfate, ammonium chloride, ammonium bromide and ammonium fluoride. If pH adjustment of the deposition solution is desired, an aqueous ammonium solution or ammonium carbonate may also be incorporated in the deposition solution. Further, the ammonium salt may be in a carboxylate form, i.e. ammonium salt of the acids hereinbefore mentioned in the carboxyl or carboxylate group-containing compound ingredient (b). The ammonium ion mitigates or avoids evolution of chlorine gas during the electrodepositing operation, and enhances both the conductivity achieved in the depositing operation and the covering power of the chromium deposit. For these desired effects, the concentration of ammonium ion should be at least 0.2 molar concentration. The concentration of ammonium ion may be increased up to the saturation point.

If desired, the deposition solution may be furnished with alkali metal salts or alkali earth metal salts. Such salts include, for example, potassium chloride, sodium chloride, magnesium chloride, potassium sulfate, sodium sulfate and magnesium sulfate. These salts may also be used either alone or in combination. These salts enhance the conductivity achieved in the electrodepositing operation. The concentration of these salts is not particulary restricted, but may be usually below 4 molar concentration.

Decorative articles with a chromium alloy deposit of a desirable bright finish can also be easily obtained by using the deposition solution of the invention, although such articles with the chromium alloy deposit are difficult to prepare by using conventional hexavalent chromium deposition solutions. That is, metals capable of forming alloys with chromium, for example, nickel, iron, cobalt, molybdenum, tungsten, manganese, rhodium, tin, zinc and cadmium are used together with the water-soluble trivalent chromium salts. These metals may be used either alone or in combination, i.e., the alloy may be binary or more. These metals are incorporated in the deposition solution in a water-soluble salt form such as a chloride or a sulfate. The concentration of these metals in the deposition solution may suitably be determined depending upon the desired composition of the chromium alloy deposit. The composition of the chromium alloy deposit can be varied not only by changing the concentrations of trivalent chromium and another metal, but also by changing the depositing operation conditions such as the pH, temperature and current density.

The deposition solution of the invention can be prepared even at room temperature. The depositing operation can be carried out at a temperature of from approximately 10° C. to 50° C. The pH of the deposition bath is preferably not higher than 5.0. The pH, once adjusted by adding an adjuster such as aqueous ammonium, ammonium carbonate, hydrochloric acid or sulfuric acid upon the preparation of the deposition solution, changes only to a slight extent because the aluminum salt and the like possess a strong buffering capability. It is preferable to suitably agitate the deposition bath during the deposition operation for the desired uniform and bright finish.

As an anode used in the electrodeposition operation, inert electrodes such as carbon electrodes may conveniently be used. The substrates employed during operation of the bath may be conventional, and include, for example, iron, copper, nickel, zinc, aluminum and their alloys. Deposition can also be performed on plastic surfaces which are activated or prepared for the plating operation.

The advantages of the chromium deposition solution of the present invention are summarized as follows. First, a decorative chromium plate with a desirable bright finish is obtained over a broad current density range and without difficulty. Secondly, enhanced current efficiency is achieved in the electrodepositing operation. Although the current efficiency varies within the range of from several percent to several tens percent, depending upon the particular composition of the deposition solution and the operating conditions, the current efficiency is usually approximately 20% when the current density applied is, for example, in the range of from 25 to 50 A/dm$^2$. This current efficiency is far larger than the current efficiency achieved with a hexavalent chromium deposition solution, the current efficiency being calculated in terms of the equivalent amount of chromium ion. Thirdly, the trivalent chromium causes no significant environmental pollution.

It is to be understood that the aqueous chromium deposition solution of the present invention can be used not only for decorative chromium or chromium alloy plating but also for electrowinning of chromium or a chromium alloy.

The invention will be further described by the following examples, in which plating tests were conducted by using a Hull cell as follows. The Hull cell used was a trapezoidal box of 267 ml in volume at the opposite ends of which were positioned a carbon anode plate and a brass cathode plate (Hull cell panel). The Hull cell tests were carried out by applying an electric current to the cell at a bath temperature of 15° to 50° C. for a period of 3 minutes at total currents of 5 amps and 10 amps. The appearance of the chromium plate produced on the Hull cell panel was diagrammatically shown in FIGS. 1A, 1B and 1C, wherein letters "E" and "C" combined with numerals given in the left hand of the respective diagrams represent Example Nos. and Comparative Example Nos., respectively, and the patterns in the respective diagrams represent the appearance of the plated surfaces as follows.

Area 1: Desirable bright
Area 2: Semi-bright
Area 3: Dull grayish
Area 4: Black powdery
Area 5: Rough
Area 6: Non-adherent deposit
Area 7: Uncovered The current efficiency, which means the proportion of the current actually utilized for chromium plating to the current applied to the plating bath, was determined as follows. A previously weighed brass plate, each surface of which was of an area of 10 cm$^2$, was suspended in the center of a two liter box filled with a plating bath. Two anode plates were also suspended at both sides of the brass plate so that the two anode plates were confronted with the respective surfaces of the brass plate at a distance of 7 cm. The confronting surface of each anode plate had an exposed area of 4cm × 8cm. The anode plates used for the determination of current efficiency in trivalent chromium plating baths were made of carbon, but those used in hexavalent chromium plating were made of lead as is conventionally used in hexavalent chromium plating. The area other than the above-mentioned exposed area was coated with an insulation coating. The current efficiency was calculated according to the following equation.

$$\text{Current efficiency (\%)} = \frac{w \times 96500 \times A}{52 \times I \times t} \times 100$$

where $w = w_1 - w_0$ ($w_1$ and $w_0$ are weights (g) of the brass plate measured after and before the current is applied to the bath, respectively.)

$I$ = total currents in amps applied to the bath, $t$ = period of time for which the currents are applied to the bath, and $A$ = valency of chromium reduced from $Cr^{3+}$ to $Cr^0$, i.e., $A=3$.

EXAMPLE 1 AND COMPARATIVE EXAMPLES 1 THROUGH 3

The ingredients shown in Table I, below, were dissolved in minor amounts of water and diluted to one liter. After the aqueous solutions were left to stand for 24 hours, the pH of each of these solutions was adjusted to 1 by adding hydrochloric acid or aqueous ammonia. Electroplating tests were conducted on these aqueous solutions at a total current of 10 amps and a bath temperature of 20° C. Test results are shown in FIG. 1A.

Table I

| Ingredient | Amounts of ingredients (moles) | | | |
|---|---|---|---|---|
| | Example 1 | Com. Ex. 1 | Com. Ex. 2 | Com. Ex. 3 |
| Chromic chloride hexahydrate | 0.8 | 0.8 | 0.8 | 0.8 |
| Aminoacetic acid | 1 | — | 1 | 1 |
| Aluminum chloride hexahydrate | 0.5 | 0.5 | — | — |
| Ammonium chloride | 1.5 | 1.5 | 1.5 | 1.5 |
| Boric acid | — | — | — | 0.8 |

As is seen from FIG. 1A, the chromium plate of Example 1 had a desirable bright finish over a broad current density range of from about 5 amps/dm$^2$ to the utmost density.

The plate of Comparative Example 1 was black powdery in a current density region of from about 10 to 15 amps/dm$^2$, and grayish and rough in the region of from 15 to 30 amps/dm$^2$. The electroplating test was repeated twice by using the plating bath of Comparative Example 1 wherein the pH of the bath was varied to 0.5 and 2.0. The resultant two plates had no desirable bright finish.

The plate of Comparative Example 2 was of a semi-bright finish in the region of from about 12 to 50 amps/dm$^2$, and dull grayish in the region of larger than 50 amps/dm$^2$. The electroplating test was repeated at varied pHs in a manner similar to Comparative Example 1, but the resultant plates did not have a bright finish.

The plate of Comparative Example 3 was of a semi-bright finish in the region of from about 7 to 40 amps/dm$^2$ and dull grayish in the region of larger than 40 amps/dm$^2$. The electroplating test was repeated at varied pHs in a manner similar to Comparative Example 1, but the resultant plates did not have a bright finish.

The above-mentioned plating tests in Example 1 and Comparative Examples 1 through 3 were repeated, except that the total currents applied to the Hull cell were 5 amps instead of 10 amps/dm$^2$. The test results were approximately similar to those in Example 1 and Comparative Examples 1 through 3, respectively.

Figure 2:
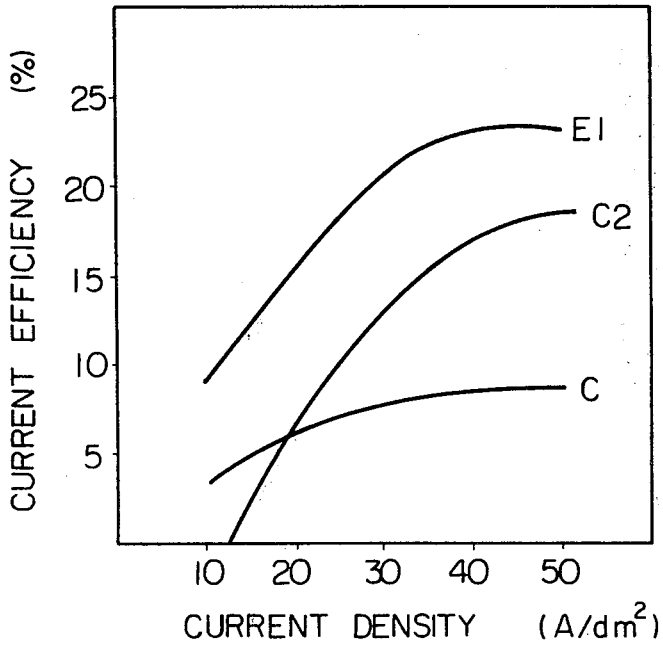

Further, the current efficiency was determined on plating baths similar to those used in Example 1 and Comparative Example 2, and further, on a hexavalent chromium plating bath. The hexavalent chromium plating bath was an aqueous solution containing 400 g/liter of chromic anhydride ($CrO_3$) and 4 g/liter of sulfuric acid, which solution is popularly used for conventional decorative chromium plating. The bath temperature in the determination of the current efficiency was 20° C. for the trivalent chromium plating baths and 50° C. for the hexavalent chromium plating bath, respectively. The results are shown in FIG. 2, wherein curves E1, C2 and C correspond to the plating baths of Example 1 and Comparative Example 2 and the hexavalent chromium plating bath, respectively. It will be apparent that the plating bath of Example 1 exhibits far improved current efficiency as compared with the other baths. In the determination of the current efficiency of the hexavalent chromium plating bath, the current efficiency was expressed in terms of that of a trivalent chromium bath, i.e., calculated based on the reaction of $Cr^{3+} \rightarrow Cr^{\circ}$. Accordingly, the expressed numerical value for the current efficiency is a half of the numerical value popularly expressed for that of a hexavalent chromium plating bath.

EXAMPLE 2 AND COMPARATIVE EXAMPLES 4 THROUGH 6

Electroplating baths were prepared from the ingredients shown in Table II, below, in a manner similar to that in Example 1 and Comparative Examples 1 through 3, except that the pH was adjusted to 0.5 instead of 1.

Table II

| Ingredient | Amounts of ingredients (moles) | | | |
|---|---|---|---|---|
| | Example 2 | Com. Ex. 4 | Com. Ex. 5 | Com. Ex. 6 |
| Chromic chloride hexahydrate | 0.6 | 0.6 | 0.6 | 0.6 |
| Aminoacetic acid | 1.2 | — | 1.2 | 1.2 |
| Aluminum chloride hexahydrate | 0.7 | 0.7 | — | — |
| Ammonium chloride | 2.0 | 2.0 | 2.0 | 2.0 |
| Boric acid | — | — | — | 0.6 |

Figure 1B:
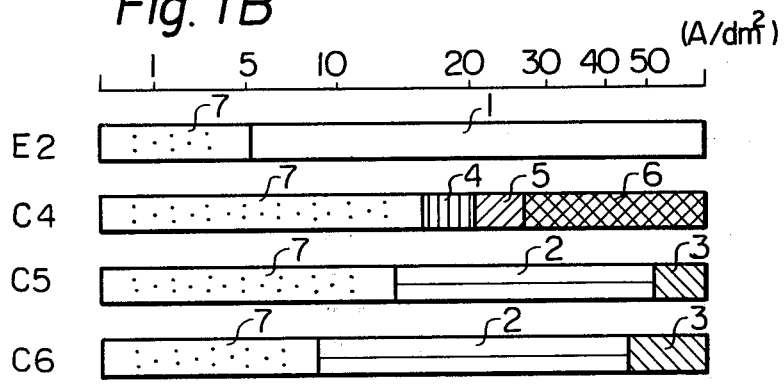

Electroplating tests were conducted on these baths at a total current of 10 amps and a bath temperature of 30° C. Test results are shown in FIG. 1B.

EXAMPLE 3 AND COMPARATIVE EXAMPLES 7 THROUGH 9

Electroplating baths were prepared from the ingredients shown in Table III, in a manner similar to that in Example 2, except that the pH was adjusted to 1.8 instead of 0.5.

Table III

| Ingredient | Amounts of ingredients (moles) | | | |
|---|---|---|---|---|
| | Example 3 | Com. Ex. 7 | Com. Ex. 8 | Com. Ex. 9 |
| Chromic chloride hexahydrate | 0.6 | 0.6 | 0.6 | 0.6 |
| Chromic sulfate octadecahydrate | 0.2 | 0.2 | 0.2 | 0.2 |
| Aminoacetic acid | 1.0 | — | 1.0 | 1.0 |
| Aluminum sulfate octadecahydrate | 0.2 | 0.2 | — | — |
| Ammonium chloride | 3.0 | 3.0 | 3.0 | 3.0 |
| Boric acid | — | — | — | 0.7 |

Figure 1C:
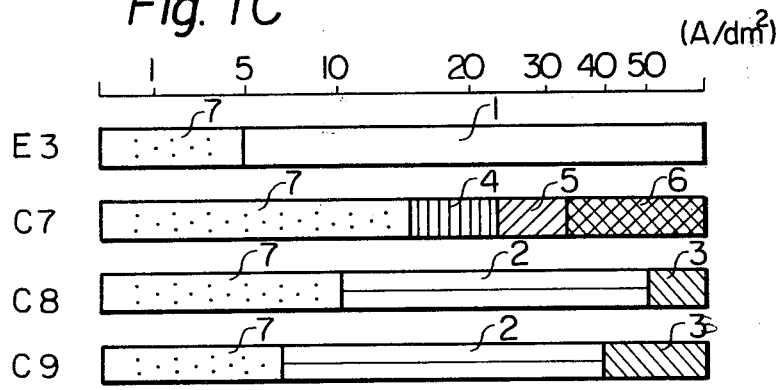

Electroplating tests were conducted on these baths at a total current of 10 amps and a bath temperature of 25° C. The test results are shown in FIG. 1C.

EXAMPLES 4 THROUGH 6

Electroplating baths were prepared from the ingredients shown in Table IV, below, in a manner similar to those in the preceding Examples, except that the pH was adjusted to the values shown in Table IV, below, by adding sulfuric acid or aqueous ammonia.

Table IV

| Ingredient | Amounts of ingredients (moles) | | |
|---|---|---|---|
| | Example 4 | Example 5 | Example 6 |
| Chromic chloride hexahydrate | — | — | 0.4 |
| Chromium alum | 0.3 | — | — |
| Basic chromic sulfate | — | 0.8* | — |
| Aminoacetic acid | 0.6 | 1.0 | 1.0 |
| Chromic sulfate octadecahydrate | 0.2 | — | — |
| Aluminum chloride hexahydrate | — | 0.5 | 0.3 |
| Ammonium sulfate | 1.5 | — | — |
| Ammonium chloride | — | — | 0.5 |
| Potassium chloride | — | — | 1 |
| Bath pH | 1.5 | 2 | 2.5 |
| Bath Temperature (° C) | 30 | 20 | 30 |

*Calculated in terms of the moles of trivalent Cr atom

Electroplating tests were conducted on these baths at a total current of 10 amps and a bath temperature shown in Table IV. The resultant chromium plates had a desirable bright finish over a broad current density range similar to that in Example 1, i.e., from 5 amps/dm$^2$ to approximately 100 amps/dm$^2$.

EXAMPLES 7 AND 8

Electroplating baths were prepared from the ingredients shown in Table V, below, in a manner similar to those in the preceding Examples, except that the pH was adjusted to the values shown in Table V, below.

Table V

| Ingredient | Amounts of ingredients (moles) | |
|---|---|---|
| | Example 7 | Example 8 |
| Chromic chloride hexahydrate | 0.5 | 1.2 |
| Glycolic acid | 1.4 | 2.0 |
| Aluminum chloride | 0.3 | 0.7 |
| Ammonium chloride | 1.5 | 1 |
| Sodium chloride | — | 1 |
| Bath pH | 2 | 1.5 |
| Bath temperature (° C) | 30 | 40 |

Electroplating tests were conducted on these baths at a total current of 10 amps and a bath temperature shown in Table V. The resultant chromium plates had a desirable bright finish, similar to that in Example 1, over a current density range of from 8 amps/dm$^2$ to approximately 100 amps/dm$^2$.

EXAMPLES 9 THROUGH 11

Electroplating baths were prepared from the ingredients shown in Table VI, below, in a manner similar to those in the preceding Examples, except that the pH was adjusted to the values shown in Table VI, below.

Table VI

| Ingredient | Amounts of ingredients (moles) | | |
|---|---|---|---|
| | Example 9 | Example 10 | Example 11 |
| Chromic chloride hexahydrate | — | — | 0.5 |
| Chromic sulfate octadecahydrate | 0.8 | 1.0 | — |
| Glycolic acid | 1.4 | 1.6 | 1.4 |
| Aluminum chloride | — | 0.5 | — |

Table VI-continued

| Ingredient | Amounts of ingredients (moles) | | |
|---|---|---|---|
| | Example 9 | Example 10 | Example 11 |
| Aluminum sulfate octadecahydrate | 0.1 | — | 0.1 |
| Ammonium chloride | — | 2.0 | 2.0 |
| Ammonium sulfate | 1 | — | — |
| Bath pH | 1.5 | 0.5 | 0.5 |
| Bath temperature (° C) | 20 | 30 | 20 |

Electroplating tests were conducted on these baths at a total current of 10 amps and a bath temperature shown in Table VI. The resultant chromium plates had a desirable bright finish, similar to that in Example 1, over a current density range of from 8 amps/dm$^2$ to approximately 100 amps/dm$^2$.

EXAMPLES 12 THROUGH 14

Electroplating baths were prepared from the ingredients shown in Table VII, below, in a manner similar to those in the preceding Examples, except that the pH was adjusted to the values shown in Table VII, below.

Table VII

| Ingredient | Amounts of ingredients (moles) | | |
|---|---|---|---|
| | Example 12 | Example 13 | Example 14 |
| Chromic chloride hexahydrate | 0.3 | 0.8 | — |
| Chromic sulfate octadecahydrate | — | — | 0.4 |
| Formic acid | 1.0 | 0.8 | 1.0 |
| Aluminum chloride hexachloride | 0.4 | 0.7 | — |
| Aluminum sulfate octadecahydrate | — | — | 0.2 |
| Ammonium sulfate | — | — | 1.0 |
| Bath pH | 3 | 1.5 | 2.5 |
| Bath temperature (° C) | 20 | 30 | 20 |

Electroplating tests were conducted on these baths at a total current of 10 amps and a bath temperature shown in Table VII. The resultant chromium plates had a desirable bright finish over a broad current density range similar to that in Example 1, i.e., from 5 amps/dm$^2$ to approximately 100 amps/dm$^2$.

EXAMPLES 15 THROUGH 17

Electroplating baths were prepared from the ingredients shown in Table VIII, below, in a manner similar to those in the preceding Examples, except that the pH was adjusted to the values shown in Table VIII, below.

Table VII

| Ingredient | Amounts of ingredients (moles) | | |
|---|---|---|---|
| | Example 15 | Example 16 | Example 17 |
| Chromic chloride hexahydrate | 0.8 | — | 0.6 |
| Chromic sulfate octadecahydrate | — | 0.3 | — |
| Oxalic acid | 0.4 | 0.4 | 0.5 |
| Aluminum chloride hexahydrate | 0.5 | 0.3 | 0.6 |
| Ammonium chloride | 2.5 | 2.0 | 1.5 |
| Sodium chloride | — | — | 0.2 |
| Bath pH | 1 | 2 | 0.1 |
| Bath temperature (° C) | 20 | 30 | 20 |

Electroplating tests were conducted on these baths at a total current of 10 amps and a bath temperature shown in Table VIII. The resultant chromium plates had a desirable bright finish, similar to that in Example 1, over a current density range of from 7 amps/dm$^2$ to approximately 100 amps/dm$^2$.

EXAMPLES 18 THROUGH 20

These examples illustrate the preparation of chromium alloy plates.

Electroplating baths were prepared from the ingredients shown in Table IX, below, in a manner similar to those in the preceding Examples, except that the pH was adjusted to the values shown in Table IX, below.

Table IX

| Ingredient | Amounts of ingredients (moles) | | |
|---|---|---|---|
| | Example 18 | Example 19 | Example 20 |
| Chromic chloride hexahydrate | 0.8 | 0.8 | 0.8 |
| Ferric chloride hexahydrate | 0.03 | — | — |
| Cobaltous chloride hexahydrate | — | 0.1 | — |
| Nickelous sulfate hexahydrate | — | — | 0.1 |
| Aminoacetic acid | 1.0 | 1.0 | 1.0 |
| Aluminum chloride hexahydrate | 0.5 | 0.5 | — |
| Aluminum sulfate octadecahydrate | — | — | 0.2 |
| Ammonium chloride | 2.0 | 1.9 | 2.0 |
| Bath pH | 1.0 | 0.3 | 1.5 |
| Bath temperature (° C) | 20 | 25 | 30 |

Electroplating tests were conducted on these baths in a manner similar to that in Example 1 wherein the bath temperature was as shown in Table IX and the current-applying time was five minutes. The resultant chromium alloy plates had a desirable bright finish, similar to that in Example 1, over the broad current density ranges of from 1 amp/dm$^2$ in Example 18, from 0.3 amp/dm$^2$ in Example 19 and from 0.2 amp/dm$^2$ in Example 20, respectively, to approximately 100 amps/dm$^2$.

The chromium alloy plates had the compositions, shown in Table X, below, at a point on the Hull cell panel which corresponds to the current density of 20 amps/dm$^2$.

Table X

| Metal ingredients | Example 18 (%) | Example 19 (%) | Example 20 (%) |
|---|---|---|---|
| Cr | 57 | 17 | 78 |
| Fe | 43 | — | — |
| Co | — | 83 | — |
| Ni | — | — | 22 |

What we claim is:

1. An aqueous acidic chromium electrodeposition solution which contains, in dissolved form:
   a. a trivalent chromium salt in a molar concentration of from 0.1 to saturation expressed in terms of the molar concentration of trivalent chromium;
   b. at least one compound selected from the group consisting of unsubstituted aliphatic carboxylic acids, amino-substituted aliphatic carboxylic acids, hydroxy-substituted aliphatic carboxylic acids and salts thereof, said compound having 1 to 5 carbon atoms in the molecule, in a concentration such that the molar ratio of the total carboxyl or carboxylate groups to the total trivalent chromium atoms in the salt (a) is within the range of from 0.5 to 5.0;
   c. an aluminum salt in a molar concentration of from 0.1 to 2.0 expressed in terms of the molar concentration of aluminum, and;
   d. ammonium ion in a molar concentration of at least 0.2.

2. An aqueous acidic chromium electrodeposition solution according to claim 1, which further contains at least one salt selected from the group consisting of alkali metal salts and alkali earth metal salts, in a molar concentration of below 4.

3. An aqueous acidic chromium electrodeposition solution according to claim 1 wherein the trivalent chromium salt is at least one salt selected from the group consisting of chromic chloride and chromic sulfate.

4. An aqueous acidic chromium electrodeposition solution according to claim 1, which contains chromic chloride, an amino acid, aluminum chloride and ammonium chloride.

5. An aqueous acidic chromium electrodeposition solution according to claim 1, which further contains at least one metal selected from the group consisting of iron, nickel, cobalt, molybdenum, tungsten, manganese, rhodium, tin, zinc and cadmium.

* * * * *